United States Patent [19]

Chiang

[11] Patent Number: 4,995,015

[45] Date of Patent: Feb. 19, 1991

[54] DIVER'S WATCH WITH DEPTH GAUGE

[75] Inventor: Richard C. Chiang, Woodside, N.Y.

[73] Assignee: Telux-Pioneer, Inc., Woodside, N.Y.

[21] Appl. No.: 158,597

[22] Filed: Feb. 22, 1988

[51] Int. Cl.[5] ..... G04B 47/06

[52] U.S. Cl. ..... 368/11; 368/10

[58] Field of Search ..... 368/11

[56] References Cited

U.S. PATENT DOCUMENTS

| | | | |
|---|---|---|---|
| 2,763,122 | 9/1956 | Hayes | 368/11 |
| 3,253,466 | 5/1966 | Chough | 368/11 |
| 4,194,356 | 3/1980 | Mazzilli | 368/11 |
| 4,257,112 | 3/1981 | Hubner | 368/11 |

FOREIGN PATENT DOCUMENTS

| | | | |
|---|---|---|---|
| 1523923 | 10/1969 | Fed. Rep. of Germany | 368/11 |
| 19788 | 2/1979 | Japan | 368/11 |
| 178688 | 8/1986 | Japan | 368/11 |

*Primary Examiner*—Bernard Roskoski

*Attorney, Agent, or Firm*—Charles E. Baxley

[57] ABSTRACT

A wrist watch has a casing having a face, an analog time display on the face on which the current time is marked by a pair of hands, a semicircularly arcuate bar depth gauge display on the face on which the depth is marked. The depth display is of a circular like configuration and generally surrounds and lies outside the orbits of the hands on the watch face. The bar display is operative for displaying depth by changing the appearance of an analogous portion of same.

1 Claim, 1 Drawing Sheet

DIVER'S WATCH WITH DEPTH GAUGE

FIELD OF THE INVENTION

The present invention relates to a watch. More particularly this invention concerns a wrist watch provided with a depth gauge.

BACKGROUND OF THE INVENTION

It is known to provide a wrist watch with sensors and displays for showing altitude (see U.S. Pat. Nos. 4,694,694 of depth (see U.S. Pat. Nos. 3,377,860, 3,992,949, 4,352,168, and 4,611,923 respectively of Masters, Edmondson, Anderson, and Kawahara). In my copending application Ser. No. 158,598, entitled Camper's Watch with Hygrometer and Barometer filed jointly herewith on Feb. 22, 1988, I describe a wrist watch incorporating bar type gauges which provide an indication of humidity and pressure. The systems shown in the above patents have not proven effective in use as they are difficult to read in the low-visibility conditions underwater. For instance either the dial of the depth gauge becomes confused with the watch hands, or the meander column of the gauge (in Edmondson) gets confused with the time display, making it impossible to accurately determine the actual depth.

OBJECTS OF THE INVENTION

It is therefore an object of the present invention to provide an improved watch equipped with a depth gauge.

Another object is the provision of such a watch with depth gauge which overcomes the above-given disadvantages, that is which is easy to read under virtually any circumstances.

SUMMARY OF THE INVENTION

A wrist watch according to the invention has an analog time display including a generally circular watch face and rotary minute and hour hands, a depth gauge having an arcuate bar display generally surrounding and lying outside the orbits of the hands on the watch face, and a transducer/driver for detecting depth below the surface of the watch and for displaying the depth on the bar display by changing the appearance of an analogous portion of same.

Thus according to this invention the depth display is constituted as a highly visible bar of contrasting color or appearance which surrounds the analog time display. As such it is easy to read, and even easy to compare with the time display for surfacing in accordance with a standard decompression chart.

In the wrist watch according to this invention the bar display is a part circle and concentric with the rotation axis of the hands of the time display. This makes for an attractive appearance and extremely easy reading.

The watch has a strain gauge that is exposed to the surrounding water pressure and that is connected via a driver circuit to the arcuate bar display, which itself is of the liquid-crystal type. The analog watch display can be driven by a quartz-type electronic circuit to make the system of this invention extremely durable.

DESCRIPTION OF THE DRAWING

The above and other objects, features, and advantages will become more apparent from the following, reference being made to the accompanying drawing in which.

SPECIFIC DESCRIPTION

Figure 1:
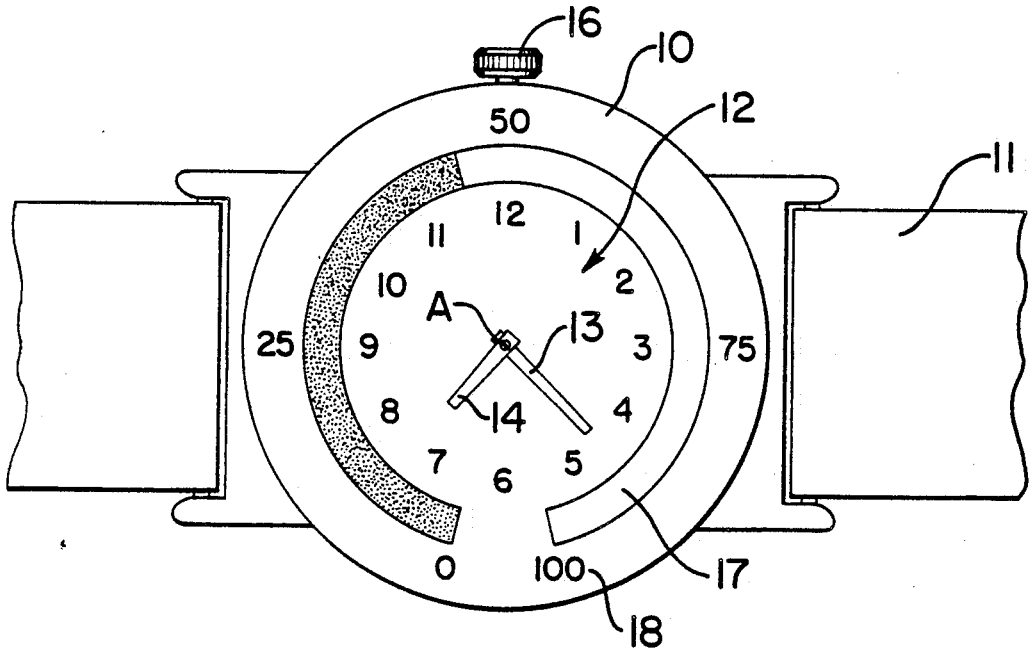
FIG. 1 is a front view of the watch according to this invention.
Figure 2:
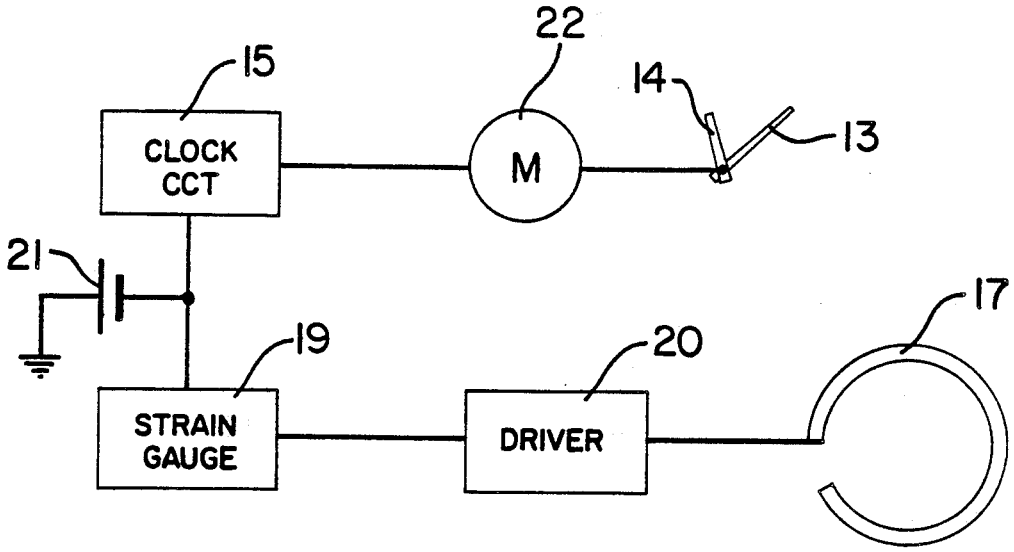
FIG. 2 is a schematic view of the circuitry for the watch.

As seen in FIG. 1 the watch according to this invention has a casing 10 provided with a standard strap 11 so that it can be worn on the wrist. This watch has a standard analog time display 12 comprised of a minute hand 13 and hour hand 14 both pivoted centrally at A on the casing 10. As seen in FIG. 2 a standard quartz-type clock circuit 15 operates a stepping motor 22 that moves the hands 13 and 14 as is known. A crown 16 is provided for setting the time.

According to this invention a liquid-crystal display 17 surrounded by depth indicia 18 is provided on the watch face surrounding the time display 12. This display 17 is formed as a circularly arcuate bar having one end corresponding to the 0 ft depth and located roughly at 6:30 and an opposite end corresponding to 100 ft depth and located roughly at 5:30. A strain gauge 19 having a portion exposed on the watch casing 10 so it can respond to surrounding water pressure is connected to a driver circuit 20 that itself operates the display 17 can be of the type described in U.S. Pat. No. 4,694,410 of Murata. A battery 21 serves to power these elements as well as the clock circuit 15.

Thus as the watch is submerged the display 17 will change color. In FIG. 1 the shading indicates the appearance with the watch about 45 ft below the surface. Clearly this type of display is extremely easy to read. The time display 12 is also extremely easy to read, and when out of the water the depth display 17 does not provide any readout and confuse the use of the watch for reading time.

I claim:

1. A wrist watch comprising a casing having a face, an analog time display on the face on which the current time is marked by a pair of hands, a circularly arcuate bar depth gauge display on the face on which the depth is marked, said depth gauge having an arcuate bar display which surrounds and lies outside the orbits of the hands on the watch face, said bar depth gauge being a significant part of a circle and concentric with the axis of the hands of the watch, and said bar gauge including a liquid-crystal display which changes color only as the watch is submerged to provide easy readability and no readout when the watch is out of the water.

* * * * *